US006138640A

United States Patent [19]

Asanuma et al.

[11] Patent Number: 6,138,640

[45] Date of Patent: Oct. 31, 2000

[54] INTAKE CONTROL VALVE DEVICE FOR INTERNAL COMBUSTION ENGINE

[75] Inventors: Hiroshi Asanuma, Chita; Hiroki Yamamoto, Yokkaichi, both of Japan

[73] Assignee: Aisan Kogyo Kabushiki Kaisha, Ohbu, Japan

[21] Appl. No.: 09/336,679

[22] Filed: Jun. 21, 1999

[30] Foreign Application Priority Data

Jun. 30, 1998 [JP] Japan ..... 10-183178

[51] Int. Cl.[7] ..... F02D 9/08

[52] U.S. Cl. ..... 123/337; 251/305

[58] Field of Search ..... 123/337; 251/305, 251/306

[56] References Cited

U.S. PATENT DOCUMENTS

| | | | |
|---|---|---|---|
| 1,130,103 | 3/1915 | Plumm | 123/337 |
| 4,491,106 | 1/1985 | Morris | 123/337 |
| 4,860,706 | 8/1989 | Suzuki et al. | 123/337 |
| 5,081,972 | 1/1992 | Daly et al. | 123/337 |
| 5,669,350 | 9/1997 | Altmann et al. | 123/337 |
| 5,769,612 | 6/1998 | Thelen et al. | 251/305 |
| 5,794,591 | 8/1998 | Kalebjian et al. | 123/337 |
| 5,979,871 | 11/1999 | Forbes et al. | 123/337 |

FOREIGN PATENT DOCUMENTS

| | | |
|---|---|---|
| 56-115818 | 9/1981 | Japan . |
| 60-69339 | 5/1985 | Japan . |
| 3-286152 | 12/1991 | Japan . |

*Primary Examiner*—John Kwon
*Attorney, Agent, or Firm*—Pillsbury Madison & Sutro LLP

[57] ABSTRACT

There is disclosed an intake control valve device for an internal combustion engine in which a high sealing effect of a valve can be achieved even if dispersions in the machining precision etc. of the valve, a valve shaft and other portions as well as thermal strain deformation of these parts cause. The intake control valve device includes a butterfly-type valve provided in an intake passage in a body. A valve seat surface, which can face an outer peripheral portion of an upstream-side surface of the valve at one half-periphery portion of the valve, disposed on one side of a valve shaft, is formed on the body, and another valve seat surface, which can face an outer peripheral portion of a downstream-side surface of the valve at another half-periphery portion of the valve, disposed on another side of said valve shaft, is formed on the body. The angle $\theta_3$ of inclination of each of the two valve seat surfaces is larger than the angle $\theta_4$ of inclination of the valve in its fully-closed condition.

2 Claims, 4 Drawing Sheets

INTAKE CONTROL VALVE DEVICE FOR INTERNAL COMBUSTION ENGINE

BACKGROUND OF THE INVENTION

1. Field of the Invention

This invention relates to an intake control valve device used in an internal combustion engine.

2. Related Art

For example, JP-A-56-115818 discloses a multi-cylinder internal combustion engine in which an intake control valve of the butterfly type is provided within a surge tank to divide the interior of this surge tank into a first internal chamber and a second internal chamber. When the valve is fully opened, the two internal chambers are caused to communicate with each other so as to change an equivalent tube length of an intake passage, thereby achieving a high charging efficiency over an entire engine speed range, utilizing an intake inertia effect.

In an intake valve device used in this kind of internal combustion engine, if there is even a slight air leakage when an intake control valve is fully closed, the intake inertia efficiency is lowered, so that the charging efficiency can not be sufficiently enhanced. Therefore, the intake valve device is required to have a high sealing effect.

In order to enhance the sealing effect in the fully-closed condition, there has been proposed a valve device (as disclosed in JP-A-03-286152 and JP-U-60-69339) in which a body, housing the valve therein, has a valve seat surface of a stepped configuration, against which an outer peripheral portion of an upstream-side surface in one half of a circular portion of the valve can abut in the fully-closed condition of the valve, and another valve seat surface of a stepped configuration against which an outer peripheral portion of a downstream-side surface of another half of a circular portion of the valve can abut in the fully-closed condition of the valve.

This conventional valve device will now be described with reference to FIGS. 5 and 6.

FIG. 5 shows the valve device disclosed in JP-A-03-286152. A valve shaft 103, which can be rotated by opening-closing control means, extends through an exhaust passage 102 in a body 101, and a butterfly-type valve 104 is fixedly mounted on the valve shaft 103. A valve seat surface 106 of a stepped configuration, against which an outer peripheral portion 105 in one half of a circular portion of the valve 104 can abut in the fully-closed condition of the valve 104, is formed in an inner peripheral surface of the body 101 generally over a half of the periphery thereof. A valve seat surface 108 of a stepped configuration, against which an outer peripheral portion 107 of another half of the circular portion of the valve 104 can abut in the fully-closed condition of the valve 104, is formed in the inner peripheral surface of the body 101 generally over a half of the periphery thereof. The angle $\theta_1$ of each of the two valve seat surfaces 106 and 108 (in the rotating direction of the valve) with respect to a plane perpendicular to the axis of the exhaust passage 102 is equal to the angle $\theta_2$ of inclination of the valve 104 in its fully-closed condition. In order to enhance the sealing effect, opposite ends (edges) 109, 110 of each of the two valve seat surfaces 106 and 108 in the direction of the periphery thereof are formed close to the proximal portions of the valve shaft 103, respectively.

FIG. 6 shows the valve device disclosed in JP-U-60-69339. In the valve device, two semi-cylindrical sleeves 202 and 203 are mounted on an inner peripheral surface of a body 201, and the two valve seat surfaces 106 and 108 of a stepped configuration, shown in FIG. 5, are formed by end surfaces 204 and 205 of the two sleeves 202 and 203, respectively. The angle $\theta_1$, of each of the two valve seat surfaces 206 and 207 (formed respectively by the end surfaces 204 and 205) with respect to the perpendicular plane to the axis of the exhaust passage is equal to the angle $\theta_2$ of inclination of the valve 208 in its fully-closed condition. Opposite ends (edges) 209, 210 of each of the two valve seat surfaces 206 and 207 are formed close to proximal portions of a valve shaft 211, respectively.

Incidentally, there are dispersions in the machining precision and assembling precision of the above valve, valve shaft and valve seat surfaces, and besides these parts are subjected to thermal strain deformation due to a temperature change.

Therefore, in the above construction in which the angle $\theta_1$ of each of the two valve seat surfaces 106 and 108 (206 and 207) is equal to the angle $\theta_2$ of the valve in its fully-closed condition, and the opposite ends (edges) 109, 110 (209, 210) of each of the two valve seat surfaces 106 and 108 (206 and 207) are formed close to the proximal portions of the valve shaft 103 (211), respectively, there is a possibility that before the valve 104 (208) is fully closed, the valve 104 (208) and the proximal portions of the valve shaft 103 (211) interfere with the ends (edges) 109 and 110 (209 and 210) because of dispersions in the machining precision and assembling precision and the thermal strain deformation, and as a result the valve 104 (208) is prevented from further rotation, so that the valve fail to be completely seated on the valve seat surfaces, thus lowering the sealing effect.

SUMMARY OF THE INVENTION

It is therefore an object of this invention to provide an intake control valve device for an internal combustion engine, in which a high sealing effect of a valve can be achieved even if dispersions in the machining precision etc. of the valve, a valve shaft and other portions, as well as thermal strain deformation of these parts, are encountered.

According to the present invention, there is provided an intake control valve device for an internal combustion engine, comprising a butterfly-type valve provided in an intake passage in a body, wherein a valve seat surface, which can face an outer peripheral portion of an upstream-side surface of the valve at one half-periphery portion of the valve, disposed on one side of a valve shaft, is formed on the body, and another valve seat surface, which can face an outer peripheral portion of a downstream-side surface of the valve at another half-periphery portion of the valve, disposed on another side of the valve shaft, is formed on the body;

wherein an angle of inclination of each of the two valve seat surfaces is larger than an angle of inclination of the valve in its fully-closed condition, and opposite ends of each of the two valve seat surfaces are spaced from the valve and the valve shaft.

In the present invention, the inclination angle of the two valve seat surfaces is larger than the angle of inclination of the valve in its fully-closed condition, and the opposite ends of each valve seat surface are spaced from the valve and the valve shaft. Therefore, even if dispersions in the machining precision etc. of the valve, the valve shaft and other portions as well as thermal strain deformation of these parts cause, the opposite ends of each valve seat surface will not interfere with the valve and the root portions of the valve shaft when the valve is fully closed.

In the invention, only those portions of each of the two valve seat surfaces in a direction of an axis of the valve shaft may be designed to be inclined at an angle larger than the angle of inclination of the valve in its fully-closed condition while the other portions of each valve seat surface are inclined at the same angle as the angle of inclination of the valve in its fully-closed condition.

In this construction, the spaced portions between the valve and each valve seat surface is smaller in the fully-closed condition of the valve, and therefore the length of contact between the valve and each valve seat surface in the peripheral direction is longer, and the contact surfaces are larger, so that the higher sealing effect is achieved in the fully-closed condition of the valve.

DESCRIPTION OF THE PREFERRED EMBODIMENTS

Preferred embodiments according to the present invention will now be described with reference to FIGS. 1 to 4B.

Figure 1:
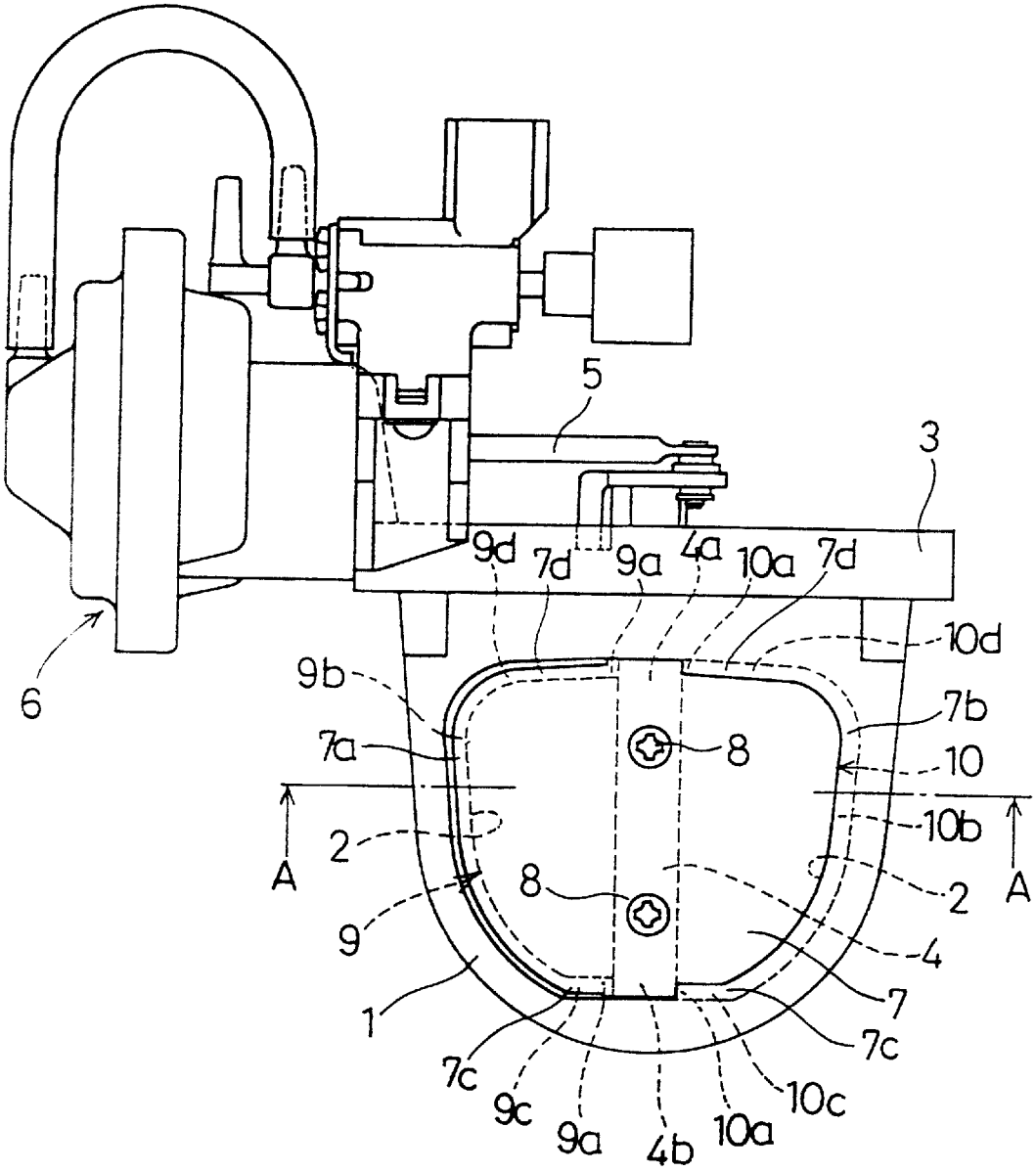
FIG. 1 is a plan view showing a valve in a fully-closed condition of a first embodiment of an intake control valve device for an internal combustion engine according to the invention.
Figure 2A:
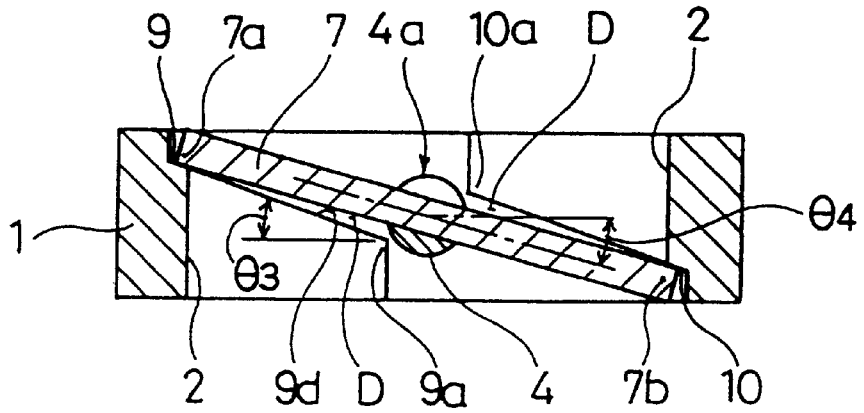
FIG. 2A is a cross-sectional view taken along the line IIA—IIA of FIG. 1.
Figure 2B:
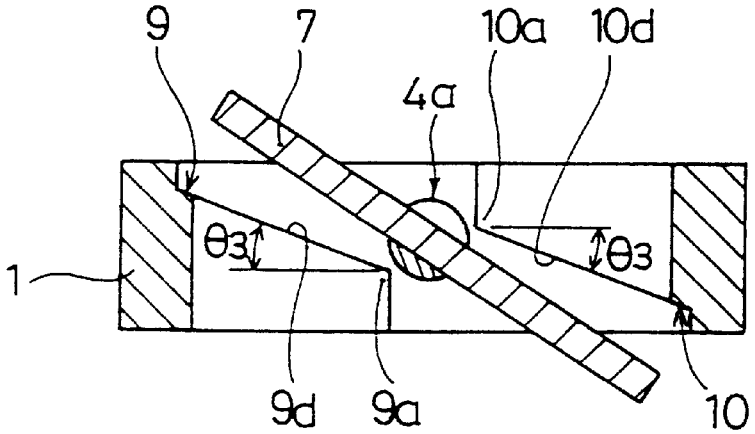
FIG. 2B is a view similar to FIG. 2A, but showing a slightly-opened condition of the valve.
Figure 3:
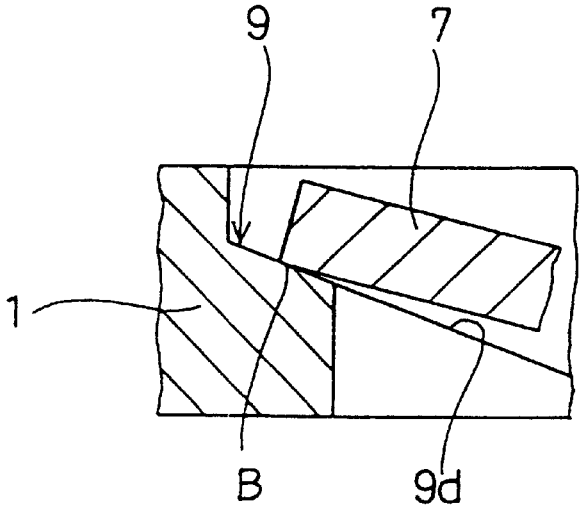
FIG. 3 is an enlarged cross-sectional view showing the condition of contact of the valve with a valve seat in FIG. 2A.

FIGS. 1 to 3 show a first embodiment of the invention applied to an intake device of a multi-cylinder internal combustion engine. In FIG. 1, a body 1 is in the form of a plate, and an intake passage 2 is formed through a central portion of the body 1. The body 1 is inserted into a surge tank (not shown) of the intake device of the multi-cylinder internal combustion engine, and is mounted thereon through a flange 3.

The body 1 has a valve shaft 4 extending across the intake passage 2, and a proximal end portion of the valve shaft 4 extends through the body 1 and the flange 3, and an outer end of this valve shaft 4 is connected to a vacuum control device 6 via an operating lever 5, and the valve shaft 4 can be rotated between an open position and a closed position by this vacuum control device 6.

The intake passage 2, when viewed in a direction of flow, has a generally trapezoidal shape (transverse cross-sectional shape) with arcuate corners, and is symmetrical with respect to the axis of the valve shaft 4 extending across it, as shown in FIG. 1.

A butterfly-type valve 7 is fixedly secured to the valve shaft 4 by screws 8, and the valve 7, when seen in a plan view, is similar in shape to the intake passage 2, and is slightly larger in size than the intake passage 2. A valve-fixing portion of the valve shaft 4 has a generally semi-circular transverse cross-section, and the valve 4 is supported on a flat surface of this valve-fixing portion, and is fixedly secured thereto by the screws 8, as shown in FIG. 2A.

A valve seat surface 9, which can face a portion of a downstream-side surface of the valve 7, which is close to the outer periphery, in a fully-closed condition of the valve 7, is formed in a stepped manner at an upstream side of one half-periphery portion of the body 1, disposed on one side of the valve shaft 4, and is larger in diameter (outer size) than the intake passage 2. Also, another valve seat surface 10, which can face a portion of an upstream-side surface of the valve 7, which is close to the outer periphery, in the fully-closed condition of the valve 7, is formed in a stepped manner at a downstream side of another half-periphery portion of the body 1, disposed on another side of the valve shaft 4, and is larger in diameter (outer size) than the intake passage 2.

In the fully-closed condition of the valve 7, the outer size of the two valve seat surfaces 9 and 10 is slightly larger than the outer size of the valve 7 defined by the outer periphery thereof.

The two valve seat surfaces 9 and 10 are inclined in a direction of inclination of the valve 7 in its fully-closed condition, and the inclination angle $\theta_3$ of each of the valve seat surfaces 9 and 10 is larger than the angle $\theta_4$ of inclination of the valve 7 in its fully-closed condition, as shown in FIG. 2A. The two valve seat surfaces 9 and 10 are formed at the same angle $\theta_3$ over the entire half-peripheral portions thereof. More specifically, all portions of each half-periphery of the valve seat surfaces 9, 10, which are the portions 9*b* and 10*b* of the valve seat surfaces 9 and 10, located in a direction perpendicular to the axis of the valve shaft 4, and the portions 9*c*, 9*d*, 10*c*, 10*d* of the valve seat surfaces 9, 10, located in the direction of the axis of the valve shaft 4, are formed at the same angle $\theta_3$ of inclination. With this construction, opposite ends 9*a* of the valve seat surface 9 are spaced from the outer peripheral portion of the downstream-side surface of the valve 7 in its fully-closed condition while opposite ends 10*a* of the valve seat surface 10 are spaced from the outer peripheral portion of the upstream-side surface of the valve 7 in its fully-closed condition. In FIG. 2A, reference character D denotes the gap between each end 9*a*, 10*a* of the valve seat surfaces 9, 10 and each outer peripheral portion of the downstream and upstream-side surfaces of the valve 7.

The opposite ends 9*a*, 10*a* of each of the two valve seat surfaces 9 and 10 are slightly spaced from the proximal portions 4*a* and 4*b* of the valve shaft 4, respectively, as shown in FIGS. 2A and 2B.

As described above, the inclination angle $\theta_3$ of the two valve seat surfaces 9 and 10 is larger than the inclination angle $\theta_4$ of the valve 7 in its fully-closed condition, and therefore even if the valve 7 of which the dimensional error of thickness or the like is close to an upper limit within an allowable error range is used, the opposite ends 9*a* and 10*a* of the two valve seat surfaces 9 and 10 are spaced from the proximal portions of the valve shaft 4, and hence will not interfere therewith when the valve 7 is fully closed, so that opposite side portions 7*a* and 7*b* of the valve 7 in a direction perpendicular to the valve shaft 4 can be positively seated respectively on the two valve seat surfaces 9 and 10 as illustrated by B in FIG. 3.

In this condition, the opposite side portions 7*a* and 7*b* of the valve 7, as well as the side portions 9*b* and 10*b* of the two valve seat surfaces 9 and 10, are disposed generally parallel to the valve shaft 4, as shown in FIG. 1, and with this construction the valve 7 is held in linear (line) contact with each of the valve seat surfaces 9 and 10, and therefore is held in linear sealing engagement therewith, so that the sealing is positively effected at these portions.

In the fully-closed condition of the valve 7, the gap D is formed at each of those portions 7*c* and 7*d* of the valve 7 spaced from each other in the direction of the axis of the valve shaft 4. However, the amount of leakage is smaller as compared with the conventional construction in which a valve, when fully closed, interferes with opposite ends of valve seat surfaces, and is much opened. Incidentally, the amount of flow leakage in a fully-closed condition was measured, when using a valve of which the dimensional error of thickness or the like is close to an upper limit within an allowable error range and the conventional valve device construction, and as a result this flow leakage amount was 400 liters/min. On the other hand, the flow leakage amount was measured, when using this valve and the valve device construction of the present invention, and as a result this flow leakage amount was reduced to half, that is, 200 liters/min.

Figure 4A:
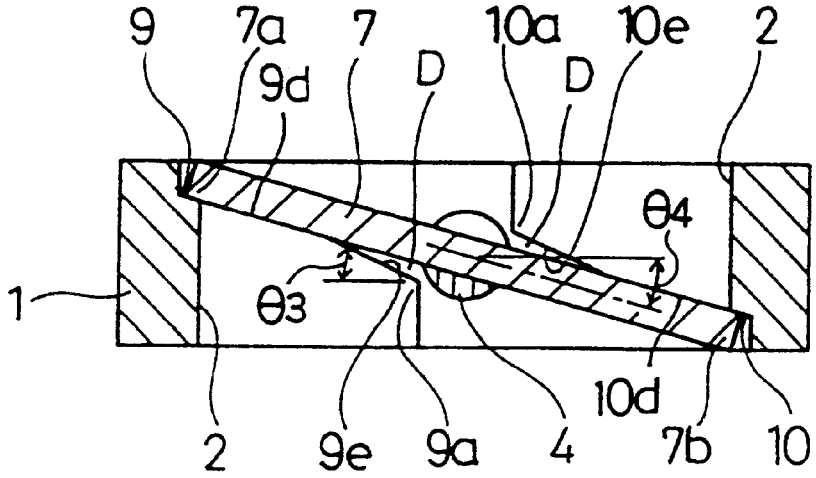
FIG. 4A is a cross-sectional view similar to FIG. 2A, but showing a second embodiment of an intake control valve device according to the invention in a fully-closed condition of a valve.
Figure 4B:
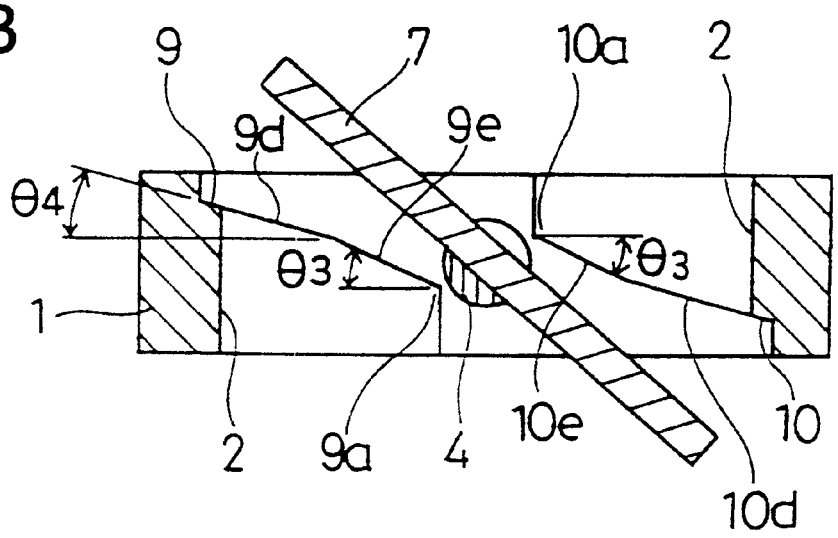
FIG. 4B is a view similar to FIG. 4A, but showing a slightly-opened condition of the valve.
Figure 5:
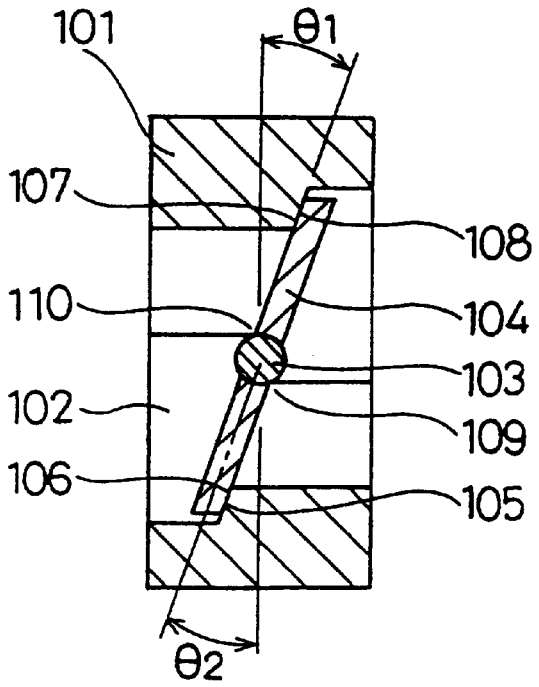
FIG. 5 PRIOR ART
FIG. 5 is a cross-sectional view showing a construction of a conventional intake control valve device for an internal combustion engine.

FIGS. 4A and 4B show a second embodiment of an intake control valve device according to the present invention. In the second embodiment, the portions in two valve seat surfaces 9 and 10, disposed near a valve shaft 4, that is, about halves 9*e* of the portions 9*c* and 9*d* of the valve seat surface 9 at a side of the valve shaft 4, which portions 9*c*, 9*d* are located at a side of the proximal portion 4*a* of the valve shaft 4, as well as about halves 10*e* of the portions 10*c* and 10*d* of the valve seat surface 10 at a side of the valve shaft 4, which portions 10*c*, 10*d* are located at a side of the proximal portion 4*b* of the valve shaft 4, are inclined at an angle $\theta_3$ larger than the angle $\theta_4$ of inclination of a valve 7 in its fully-closed condition, and the angle of the other portions of the valve seat surfaces 9 and 10 are the same as the inclination angle $\theta_4$ of the valve 7 in its fully-closed condition.

The other construction is similar to that of the first embodiment, and therefore identical portions will be designated by identical reference numerals, respectively, and explanation thereof will be omitted.

In this second embodiment, also, opposite ends 9*a* of the valve seat surface 9 are spaced a distance (gap) D from an outer peripheral portion of a downstream-side surface of the valve 7 in its fully-closed condition while opposite ends 10*a* of the valve seat surface 10 are spaced a distance (gap) D from an outer peripheral portion of an upstream-side surface of the valve 7 in its fully-closed condition, as described above for the first embodiment. Therefore, these ends 9*a* and 10*a* will not interfere with the valve 7 as in the first embodiment. Accordingly, the operation and effects similar to those of the first embodiment are achieved.

Further, in this second embodiment, when the valve 7 is fully closed, the two valve seat surfaces 9 and 10 except the above portions 9*e* and 10*e* are held in surface-to-surface contact with the valve 7, and therefore the length of contact of the valve seat surfaces 9 and 10 with the valve 7 in the peripheral direction is longer than that of the first embodiment, and the area of contact therebetween is larger, so that the higher sealing effect is achieved.

Figure 6:
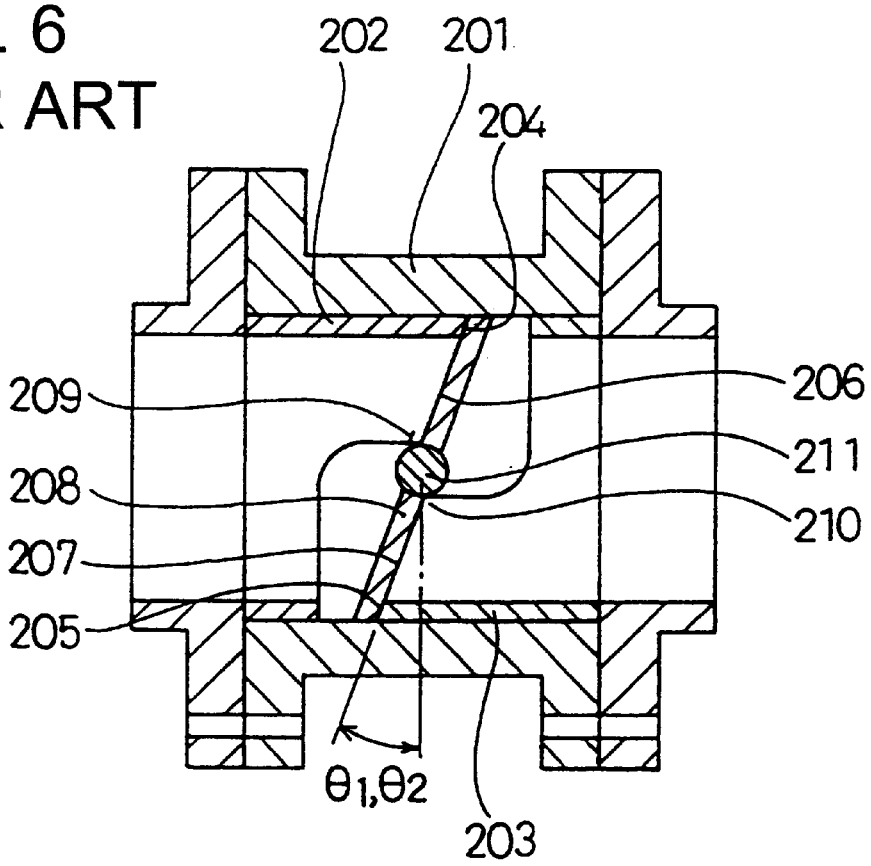
FIG. 6 PRIOR ART
FIG. 6 is a cross-sectional view showing another construction of a conventional intake control valve device for an internal combustion engine.

In the above embodiments, although the valve seat surfaces are formed on the body, such valve seat surfaces may be formed by sleeves as shown in FIG. 6.

The present invention can be applied not only to the intake control valve device (the above embodiments) in the intake device for the multi-cylinder internal combustion engine but also to any other suitable intake control valve device.

As described above, in the present invention, even if dispersions in the machining precision etc. of the valve, the valve shaft and other portions as well as thermal strain deformation of these parts cause, the valve can be securely rotated into the predetermined position to be seated on the valve seat surfaces, thereby achieving the high sealing effect.

In the case, only the portions of each of the two valve seat surfaces in the direction of the axis of the valve shaft are inclined at the angle larger than the angle of inclination of the valve in its fully-closed condition while the other portions of each valve seat surface are inclined at the same angle as the angle of inclination of the valve in its fully-closed condition, thereby achieving the higher sealing effect.

What is claimed is:

1. An intake control valve device for an internal combustion engine, comprising a butterfly-type valve provided in an intake passage in a body, wherein a valve seat surface, which can face an outer peripheral portion of an upstream-side surface of said valve at one half-periphery portion of said valve, disposed on one side of a valve shaft, is formed on said body, and another valve seat surface, which can face an outer peripheral portion of a downstream-side surface of said valve at another half-periphery portion of said valve, disposed on another side of said valve shaft, is formed on said body;

wherein an angle of inclination of each of said two valve seat surfaces is larger than an angle of inclination of said valve in its fully-closed condition, and opposite ends of each of said two valve seat surfaces are spaced from said valve and said valve shaft.

2. An intake control valve device according to claim 1, in which only portions of each of said two valve seat surfaces, which are located in a direction of an axis of said valve shaft, are inclined at an angle larger than the angle of inclination of said valve in its fully-closed condition while the other portions of each valve seat surface are inclined at the same angle as the angle of inclination of said valve in its fully-closed condition.

* * * * *